United States Patent [19]

Saxon

[11] 4,281,432

[45] Aug. 4, 1981

[54] TUBE CLEANER

[75] Inventor: George E. Saxon, Oakmont, Pa.

[73] Assignee: Condenser Cleaners Mfg. Co., Inc., Verona, Pa.

[21] Appl. No.: 63,149

[22] Filed: Aug. 2, 1979

[51] Int. Cl.[3] ..... B08B 9/04

[52] U.S. Cl. ..... 15/104.06 R

[58] Field of Search ..... 15/104.06 R, 104.06 A, 15/104.06 B; 137/268; 166/153

[56] References Cited

U.S. PATENT DOCUMENTS

| | | | |
|---|---|---|---|
| 1,325,348 | 12/1919 | Bowman | 15/104.06 R |
| 1,392,105 | 9/1921 | Bergesen, Sr. | 15/104.06 R |
| 2,170,997 | 8/1939 | Griffin | 15/104.06 R |
| 2,399,544 | 4/1946 | Danner | 15/104.06 R |
| 2,636,202 | 4/1953 | Hinzman | 15/104.06 R |
| 2,734,208 | 2/1956 | Griffin | 15/104.06 R |
| 3,496,588 | 2/1970 | Vernooy | 15/104.06 R |

FOREIGN PATENT DOCUMENTS

| | | | |
|---|---|---|---|
| 420356 | 8/1974 | U.S.S.R. | 15/104.06 R |
| 422479 | 9/1974 | U.S.S.R. | 15/104.06 R |
| 459277 | 3/1975 | U.S.S.R. | 15/104.06 R |
| 452373 | 4/1975 | U.S.S.R. | 15/104.06 R |

*Primary Examiner*—Edward L. Roberts

*Attorney, Agent, or Firm*—Parmelee, Miller, Welsh & Kratz

[57] ABSTRACT

A fluid propelled tube cleaning projectile in which the rearward head or terminal section has an outward and rearwardly extending rubber skirt, preferably formed as a cup-shaped rubber annulus which is inserted between two rigid perforated discs on a rearward axial extension of the body section of the projectile.

1 Claim, 3 Drawing Figures

TUBE CLEANER

BACKGROUND OF THE INVENTION

The present invention relates to devices for cleaning the inner walls of tubes and, in particular, to fluid driven projectiles used for cleaning condenser tubing and the like.

It is known that the cleaning of the inner walls of condensers and similar tubes can often be facilitated by driving a projectile having an attached scraper element through a tube with sufficient force so that the scraper element removes mud, slime, scale or other accumulated material from the tube wall. These scraper elements usually consist of one or more blades, bristles, or pieces of wire which extend perpendicularly from a forward elongated body section of the projectile so that, when the body section is disposed longitudinally in the tube, the scraper element is in contact with the tube wall. The body section, itself, is connected to a rearward head or terminal section which is usually cylindrical in shape and of a diameter that is somewhat less than the inner diameter of the tube. Thus, when the projectile is inserted, body first, into the tube opening and when sufficient fluid pressure is exerted on the rearward surface of the terminal section, the projectile will be driven before this fluid pressure through the length of the tube. In this way, the interior of the tube is cleaned by the projectile without need of any attached and externally manipulated lines or handles. Tube cleaning projectiles of this nature are described, for example, in U.S. Pat. Nos. 1,598,771, 2,170,997, and 2,734,208.

It is desirable that the diameter of the terminal section should approach the inner diameter of the tube, since where the gap between the terminal section and the inner wall of the tube is excessive, a large part of the propelling fluid may leak past the terminal section so that the fluid is lost for the purpose of driving the projectile. Notwithstanding the importance of minimizing the amount of fluid pressure which is lost in this manner, it is found that the maintenance of relatively tight seal between the projectile and the inner wall of the tube may not be feasible with many of the tube cleaning projectiles currently in use. That is, where the edge of the terminal sections of these projectiles is in close proximity to the tube wall there may be a danger that the forward motion of the projectile will be obstructed by irregularities in the tube wall. These irregularities may consist of dents in the tube wall or, as is more commonly the case, of insert obstructions, which are plastic tubular inserts placed in the tube at its opening for tube protection purposes. These insert obstructions abut the inner wall of the tube over a portion of its length and thereby effectively reduce the inner diameter of a tube over that length so as to make certain types of projectiles inefficient.

For example, the rigid, substantially flat terminal section shown in the projectile disclosed in U.S. Pat. No. 2,170,997 would not bend so as to pass an obstruction. When such a projectile is used to clean a tube in which an insert obstruction has been emplaced, the diameter of its terminal section must be less than that of the inner diameter of the insert obstruction. Thus, after the projectile passes the insert obstruction, the gap between the edge of the terminal section and the tube wall would increase so as to result in a loss of fluid pressure on the terminal section.

The projectile disclosed in U.S. Pat. No. 1,587,771, on the other hand, has a terminal section which is flared back so that, if sufficient fluid pressure were applied to the terminal section, it might be possible to axially compress or crush the terminal section so as to allow it to pass over an obstruction. There is, however, no indication that the terminal section disclosed in this patent has any feature which would enable it to recover its original form after it had been compressed in this manner so that fluid pressure might thereafter be lost by reason of the resulting deformation in the terminal section.

U.S. Pat. No. 2,734,208 discloses a projectile in which a rubber ring extends perpendicularly outward from the peripheral edge of the terminal section. While this ring may flex and then recover its original shape, certain disadvantages may also be associated with this design. That is, because it extends perpendicularly outward from the terminal section, the rubber ring may be pressed by the fluid on its rear side against an obstruction so that the flexing of the ring to the extent which would be necessary to bypass that obstruction might be impeded or prevented.

It is therefore an object of the present invention to provide a tube cleaning projectile which has a terminal section that has a sufficiently tight seal with the inner wall of the tube so as to allow for efficient use of its propelling fluid but which also easily flexes so as to allow it to pass obstructions in the tube.

SUMMARY OF THE INVENTION

The present invention is a tube cleaning projectile in which a rubber skirt extends outwardly and rearwardly from the terminal section of the projectile so as to allow the projectile to pass over obstructions in the tube wall without permitting excessive propelling fluid to leak past the terminal section. The terminal section is preferably formed of a cup-shaped rubber annulus which is inserted between two rigid perforated discs on a rearward axial extension of the body section.

DESCRIPTION OF THE PREFERRED EMBODIMENT

Figure 1:
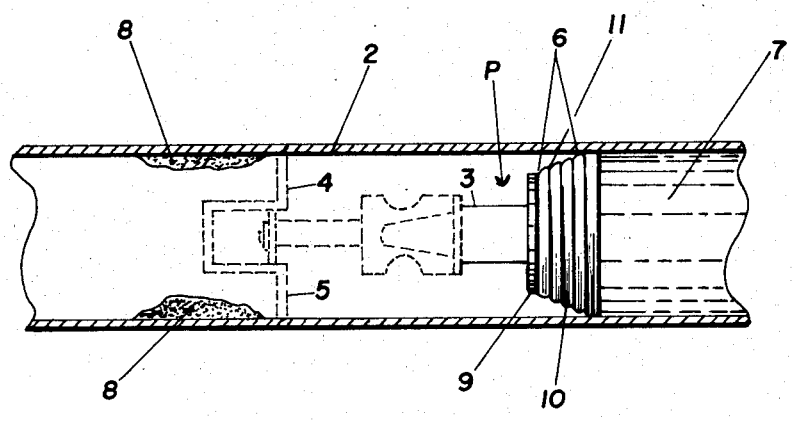
FIG. 1 is a side elevational view of the projectile of the present invention.

Referring to FIG. 1, the tube cleaning projectile P of the present invention may be propelled through a tube, the inner wall of which is shown at 2. The projectile has a body section 3 to which there is attached one or more cleaning or scraping elements such as scraper blades 4 and 5. Any of the large number of body and depending cleaning elements which are disclosed in the prior art may be used with this projectile. It is found, however, that particularly good results are obtained with the projectile of the present invention when the body section and scraper element arrangement are similar to those disclosed in the aforementioned U.S. Pat. No. 2,734,208. Accordingly, the contents of that patent are incorporated herein by reference.

Also shown in FIG. 1 is the rearward terminal section 6 of the projectile. Like other tube cleaning projectiles, pressure from fluid as at 7 is exerted on the rearward surface of terminal section 6 and drives the projectile forward through the tube 2 with sufficient force so that the blades 4 and 5 remove mud or other objectionable material as at 8. FIG. 1 also shows that the rearward terminal 6 includes a central rigid washer 9 and a rearwardly an outwardly extending rubber skirt 10. The skirt 10 has a plurality of peripheral grooves as at 11, which grooves facilitate its flexing and passage over tube wall obstructions.

Figure 2:
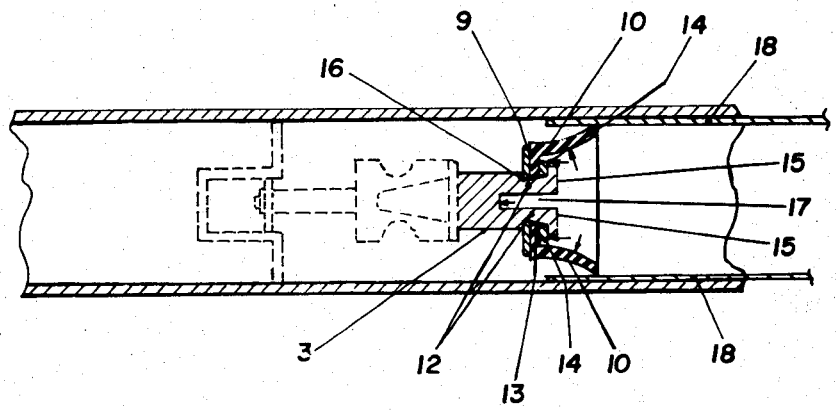
FIG. 2 is a partially cut away view of the projectile shown in FIG. 1.
Figure 3:
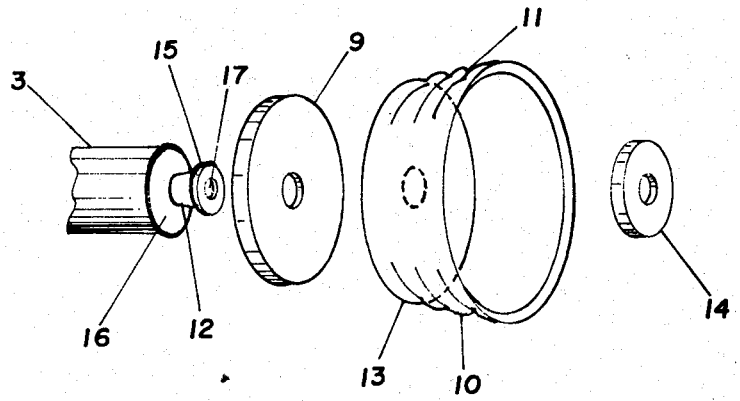
FIG. 3 is a perspective view of the projectile showing the parts of the terminal section in a disassembled form.

FIGS. 2 and 3 show, in greater detail, the rearward terminal section 6 and the means by which this section is attached to the body section 3. The body section 3 has a rearward extension 12 of rearwardly increasing diameter. The rubber skirt 10 is an integral part of a cup-shaped rubber annulus 13 and the rigid washer 9 and the rubber annulus 13 are arranged on the extension 12 so that the extension first passes through the rigid washer 9, then through the rubber annulus 13, and then through a second rigid washer 14. The rubber annulus 13 and the rigid washers 9 and 14 are retained on the extension 12 between an annular crimp 15 on the extension and an annular shoulder 16 on the body 3. There is also a central bore 17 in extension 12. This bore 17 serves as a recess into which a nipple on a fluid gun, which is commonly used to insert the projectile into a tube, is inserted. It is also believed that the fluid pressure which is exerted on the forward wall of this bore may tend to help stabilize the forward movement of the projectile. Also shown in FIG. 2 is an insert obstruction 18. AS was explained earlier, this insert obstruction is a plastic tube which is commonly inserted in the end of a condenser tube such as tube 2 at the opening of that tube. While many conventional tube cleaning projectiles pass such insert obstructions only with difficulty, with the projectile of the present invention the rubber skirt 10 flexes so as to allow the projectile to easily pass the insert obstruction 18. When the obstruction is passed, the rubber shirt 10 is axially expanded by fluid pressure so that a seal is formed with the inner wall of the tube 2 in the manner shown in FIG. 1. It is also noted that flexing of the rubber skirt 10 also allows the projectile to easily pass other types of obstructions such as tube wall dents.

So as to better illustrate the unique advantages of this projectile, arrows representing some of the forces being exerted on the projectile by the fluid are included in FIG. 2. It will be observed that the fluid not only pushes the projectile forward but that it also controls the flexing of the rubber skirt 10 so as to allow the projectile to easily pass tube obstructions while at the same time maintaining a desirably tight seal with the tube wall.

I claim:

1. A fluid propelled projectile for cleaning the inner wall of a condenser tube which is fitted with an internal sleeve over at least a portion of the tube comprising:

(a) a forward elongated body section, of a diameter which allows it to pass through said internal sleeve, having a depending scraper element extending radially outward to contact and scrape the inner wall of said tube as said projectile is propelled therethrough, said scraper being resilient in the radial direction such that said scraper can pass through said internal sleeve and over dents in said tube;

(b) a terminal section comprising:

(I) a resilient annulus having an integral, rearwardly and outwardly extending skirt; and (II) two rigid annular discs, each of said disc abutting opposite sides of said resilient annulus; and (c) a rearward axial extension from the body section, having a diameter less than the diameter of the body section, and having an axial bore and a terminal crimp, said axial extension passing through the resilient annulus and the annular discs such that the terminal section is returned on said axial extension between the body section and the terminal crimp.

* * * * *

UNITED STATES PATENT OFFICE

CERTIFICATE OF CORRECTION

PATENT NO. : 4.281.432

DATED : August 4, 1981

INVENTOR(S) : George E. Saxon

It is certified that error appears in the above-identified patent and that said Letters Patent are hereby corrected as shown below:

In the claim, second line from the end; "returned" should read --retained--.

Signed and Sealed this

Tenth Day of November 1981

[SEAL]

Attest:

GERALD J. MOSSINGHOFF

Attesting Officer

Commissioner of Patents and Trademarks